US008037952B2

(12) United States Patent
Bock

(10) Patent No.: US 8,037,952 B2
(45) Date of Patent: Oct. 18, 2011

(54) ADJUSTABLE HAND CONTROLS FOR SMALL LOADER

(75) Inventor: Timothy Bock, Bismarck, ND (US)

(73) Assignee: Clark Equipment Company, West Fargo, ND (US)

( * ) Notice: Subject to any disclaimer, the term of this patent is extended or adjusted under 35 U.S.C. 154(b) by 259 days.

(21) Appl. No.: 12/235,977

(22) Filed: Sep. 23, 2008

(65) Prior Publication Data

US 2009/0081017 A1 Mar. 26, 2009

Related U.S. Application Data

(60) Provisional application No. 60/974,633, filed on Sep. 24, 2007.

(51) Int. Cl.
*B66F 9/075* (2006.01)

(52) U.S. Cl. ..... 180/19.1; 414/640

(58) Field of Classification Search ..... 180/19.1; 414/640

See application file for complete search history.

(56) References Cited

U.S. PATENT DOCUMENTS

| | | | |
|---|---|---|---|
| 3,540,220 | A | 11/1970 | Lauck |
| 3,677,362 | A | 7/1972 | Chatterjea |
| 3,688,858 | A | 9/1972 | Jespersen |
| 4,244,427 | A | 1/1981 | Enters et al. |
| 4,396,067 | A | 8/1983 | Enters et al. |
| 4,399,882 | A | 8/1983 | O'Neill et al. |
| 4,559,844 | A | 12/1985 | Mor |
| 4,572,019 | A | 2/1986 | Suzuki |
| 4,691,795 | A | 9/1987 | Wehmeyer et al. |
| 4,864,805 | A | 9/1989 | Hager et al. |
| 5,131,483 | A | 7/1992 | Parkes |
| 5,146,735 | A | 9/1992 | McDonner |
| 5,181,579 | A | 1/1993 | Gilliem |

(Continued)

FOREIGN PATENT DOCUMENTS

| | | |
|---|---|---|
| EP | 0 565 757 | 10/1993 |

(Continued)

OTHER PUBLICATIONS

PCT search report.

*Primary Examiner* — Tony H. Winner
*Assistant Examiner* — Jacob Knutson
(74) *Attorney, Agent, or Firm* — Nickolas E. Westman; Westman, Champlin & Kelly, P.A.

(57) ABSTRACT

A control system for a walk behind loader which includes a control plate that is mounted to a shaft about an upright axis, wherein pivoting the control plate about the upright axis provides a steering input to the loader. A control handle is pivotally mounted about a generally horizontal axis and movable to provide for a direction and speed control input coupling through a control link. The control handle is mounted onto a handle mounting section section, that in turn is pivotally mounted to a support about an axis that is substantially coincident with the an axis coupling the handle to the control link, so that the control handle can be moved as the handle mounting section pivots between a raised and lowered position without causing a change in the position of controls controlled by the handle. The loader is capable of being operated by an operator walking on the ground when the control handle is in the lowered position, and by an operator standing on a platform attached to the loader, when the control handle is in the raised position.

14 Claims, 3 Drawing Sheets

U.S. PATENT DOCUMENTS

| | | | | |
|---|---|---|---|---|
| 5,212,896 | A | 5/1993 | Hillard et al. | |
| 5,279,376 | A | 1/1994 | Yang et al. | |
| 5,423,654 | A | 6/1995 | Rohrbaugh | |
| 5,488,818 | A | 2/1996 | Powers et al. | |
| 5,511,367 | A | 4/1996 | Powers et al. | |
| 5,518,079 | A | 5/1996 | Zvolanek | |
| 5,595,259 | A | 1/1997 | Gilliand et al. | 180/332 |
| 5,644,903 | A | 7/1997 | Davis, Jr. | |
| 5,647,721 | A | 7/1997 | Rohrbaugh | |
| 5,816,348 | A | 10/1998 | Barnes | |
| 5,848,520 | A | 12/1998 | Arfstrom et al. | |
| 5,860,484 | A | 1/1999 | Kauss | |
| 5,894,714 | A | 4/1999 | Braun et al. | |
| 5,896,779 | A * | 4/1999 | Biersteker et al. | 74/502.2 |
| 5,913,802 | A | 6/1999 | Mullet et al. | |
| 5,957,229 | A | 9/1999 | Ishii | |
| 6,082,083 | A | 7/2000 | Stalpes et al. | |
| 6,098,385 | A | 8/2000 | Turk | |
| 6,155,648 | A | 12/2000 | Dombeck et al. | |
| D438,218 | S | 2/2001 | McIlwraith | |
| 6,397,967 | B1 | 6/2002 | McIlwraith | |
| 6,460,640 | B1 | 10/2002 | Keagle et al. | 180/19.3 |
| 6,709,223 | B2 | 3/2004 | Walto et al. | 414/685 |
| 6,832,659 | B1 | 12/2004 | Bares et al. | 180/9.22 |
| 6,902,016 | B2 * | 6/2005 | Bares et al. | 180/19.3 |
| 7,059,434 | B2 | 6/2006 | Bares et al. | 180/19.1 |
| 2005/0011696 | A1 * | 1/2005 | Bares et al. | 180/315 |
| 2005/0036876 | A1 | 2/2005 | Walto et al. | 414/724 |
| 2006/0231302 | A1 | 10/2006 | Rose | 180/19.3 |

FOREIGN PATENT DOCUMENTS

| | | | |
|---|---|---|---|
| WO | WO 2004/062989 | A1 | 7/2004 |

* cited by examiner

ADJUSTABLE HAND CONTROLS FOR SMALL LOADER

CROSS REFERENCE TO RELATED APPLICATION

This application refers to and claims priority from U.S. Provisional Application Ser. No. 60/974,633, filed Sep. 24, 2007, which is incorporated by reference.

FIELD OF THE INVENTION

The present invention relates to hand controls for controlling the steering direction and speed of movement of a loader.

SUMMARY OF THE INVENTION

In one embodiment, the invention provides a control system for a skid steer loader including a control handle pivotally coupled to a vertical link about a first horizontal axis and pivotally coupled to a shaft about a vertical axis, wherein pivoting the control handle about the horizontal axis provides a forward/reverse direction and speed control input and pivoting the control handle about the vertical axis provides a steering control input, the control handle being pivotally coupled to a control handle support platform about a second horizontal axis co-axial with the first horizontal axis, the control handle being movable relative the control handle support platform about the second horizontal axis between a first position and a second position that change the elevations of the control handle.

Other aspects of the invention will become apparent by consideration of the detailed description and accompanying drawings.

DETAILED DESCRIPTION OF ILLUSTRATIVE EMBODIMENTS

Before any embodiments of the invention are explained in detail, it is to be understood that the invention is not limited in its application to the details of construction and the arrangement of components set forth in the following description or illustrated in following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
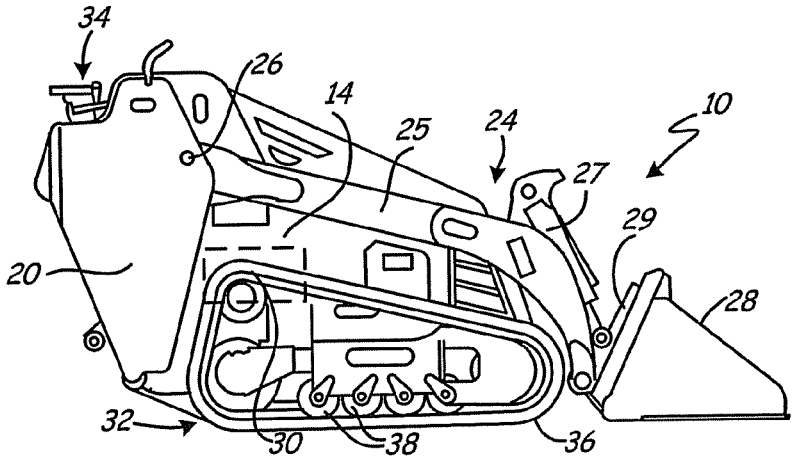
FIG. 1 shows a side view of a small loader without a ride-on platform according to an embodiment of the invention.
Figure 2:
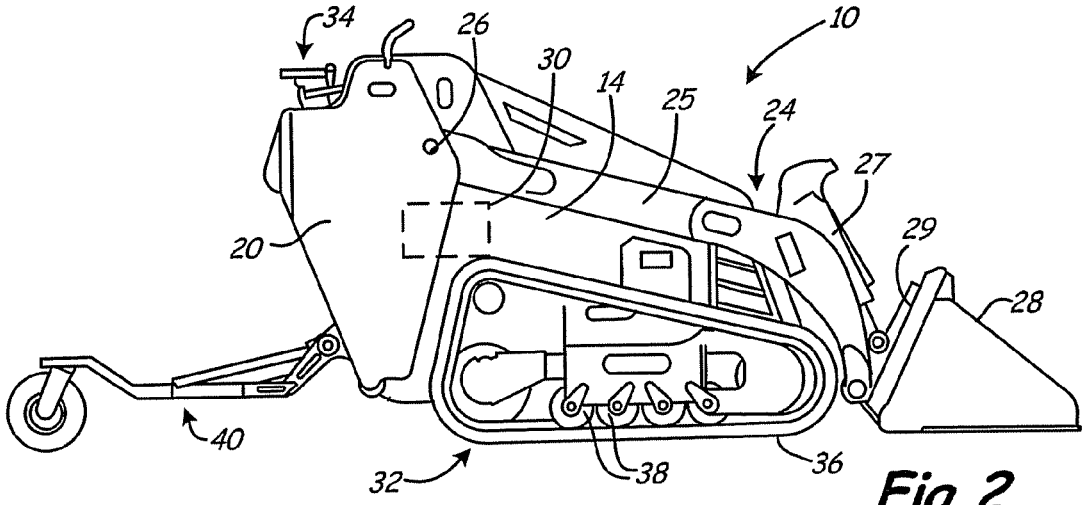
FIG. 2 shows a side view of the small loader of FIG. 1 with a ride-on platform.

FIGS. 1 and 2 show a small skid steer loader 10. The loader has a frame 12 that supports upright side plates 14 on opposite sides of the loader 10. The plates 14 are part of the frame 12 and are joined with cross plates as needed (not shown).

The rear portions of the loader 10 have rear side plates 20 that are spaced from and parallel to the frame plates 14. The spaces between the rear side plates 20 and the frame plates 14 are used for mounting a lift arm assembly 24. The lift arm assembly 24 includes individual lift arms 25 pivotally mounted as at 26 to the frame 12 and positioned in a desired location. Lift actuators or cylinders (not shown) are provided for pivoting the lift arms 25 about pivot 26 to raise and lower forward ends of the lift arms 25. A bucket control or tilt cylinder 27 is mounted to the lift arms 25 for controlling movement of a loader bucket 28, or for other accessories that may be mounted on an attachment plate 29 at the front end of the lift arms 25.

The loader 10 has an internal combustion engine, shown in dashed lines at 30, that is used for driving a hydraulic pump for the lift actuators and the tilt cylinder 27. Also, the engine 30 drives pump and motor units for a ground drive system 32 including a motor (not shown) and motor controls 34, which drive system can be electric or other type of controlled drive.

The ground drive system 32 includes drive tracks 36 mounted on the sides of the loader 10. The tracks 36 mount over suitable idler rollers 38. Wheeled loaders or vehicles would be driven with normal mechanical drive trains to the wheels, or can be operated with ground engaging wheels mounted right on motor shafts.

The loader 10 further includes a ride-on platform 40 as illustrated in FIG. 2. The ride-on platform 40 is mounted to a rear of the loader 10 to support the operator for movement over the ground or supporting surface. The operator, supported on the ride-on platform 40, can operate the loader 10 via the control system 34. The ride-on platform 40 can be detached and/or moved out of the way, as shown in FIG. 1, so that the operator can walk over the ground or supporting surface behind the loader 10 to direct operation of the loader 10 via the control system 34 at a different support level than when the ride-on platform is used.

The control system 34 is a drive and steering control assembly using a single control handle, so that an operator can steer and control speed and direction of movement of the loader 10 with one hand, if desired, in a convenient manner. Control system 34 can have a configuration as is shown and described in U.S. Pat. No. 7,059,434, the entire disclosure of which is incorporated herein by reference.

Figure 3:
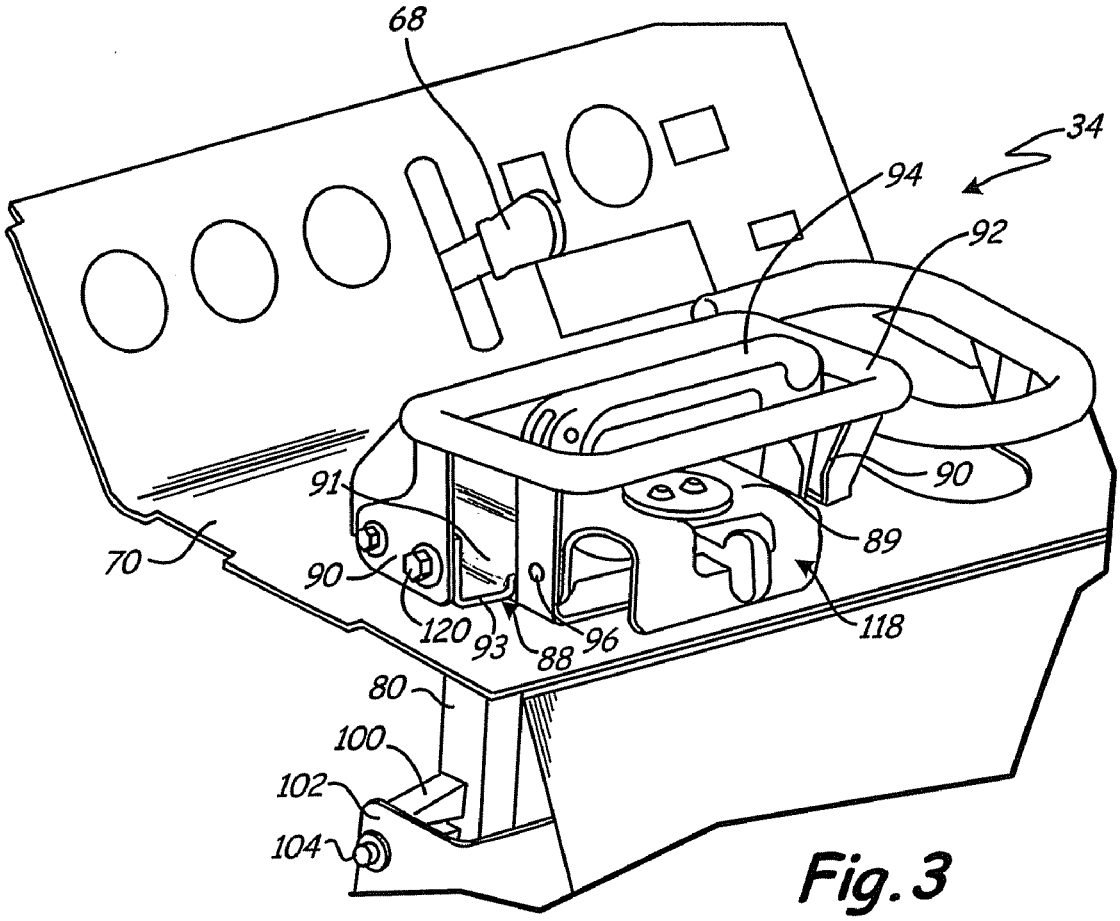
FIG. 3 shows a perspective view of the operator controls of the small loader of FIG. 1.
Figure 4:
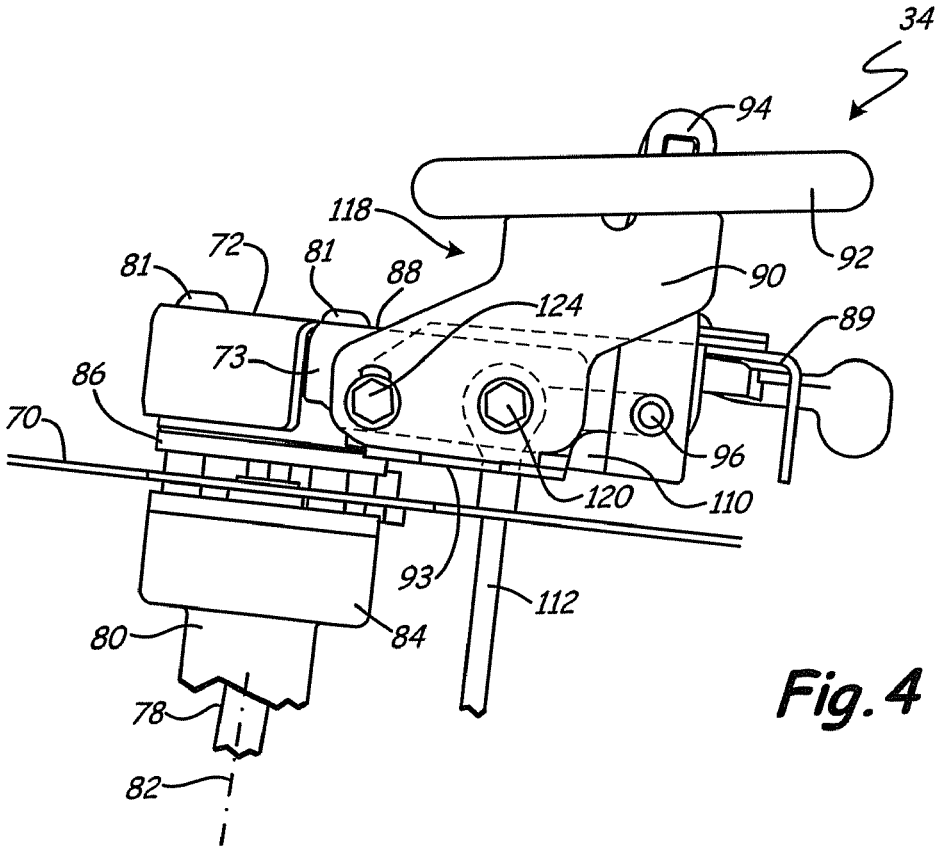
FIG. 4 shows a side cut-away view of the operator controls of FIG. 3 in a lowered position.
Figure 5:
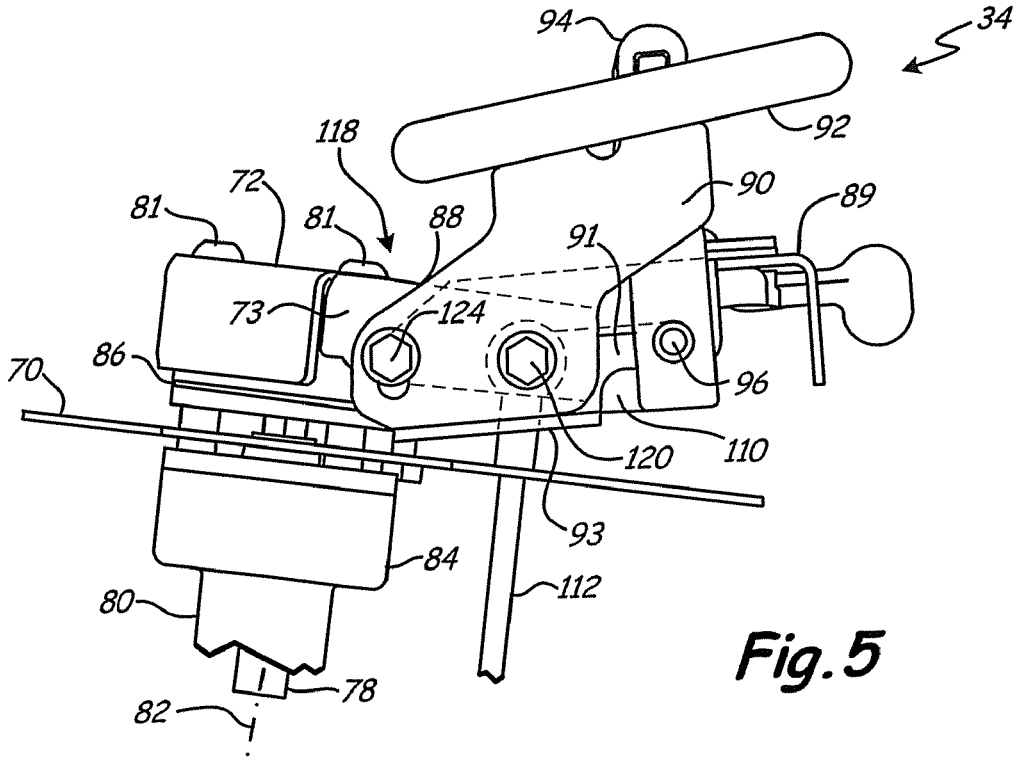
FIG. 5 shows a side cut-away view of the operator controls of FIG. 3 in a raised position.

The control system 34 is shown in more detail in FIGS. 3-5. It should be noted that a lever (not shown) can be provided for controlling the cylinders for the lift arm 25, and the valves for controlling other cylinders, such as the tilt cylinder 27, can be controlled as desired. A throttle 58 is provided for controlling the engine speed of engine 30.

The control system 34 forms an assembly supported relative to a control panel 70 which is fixed to side plates 14. The controls 34 include a swinging or movable control handle support plate or platform 72. As shown in FIG. 5, for example, a vertical shaft 78 has a lower end supported on the frame. The shaft 78 extends upwardly and can be rotatably supported at the upper end of the suitable manner, relative to the side plate 14 or with a bracket to panel 80, which is fixed to the side plates. The shaft 78 is positioned at a desired location to position and mount the control support plate 72 in its proper location. The shaft 78 does not move relative to the frame except to rotate, and does not have to be vertical. It can incline somewhat for convenience.

The shaft 78 forms a main mounting support for the control assembly 34 and a sleeve or hub 80 is rotatably mounted on the shaft 78. The sleeve 80 is located in position axially along the shaft 78 with bearings held in place in a suitable manner. The sleeve 80 is free to rotate about an axis 82 of the shaft 78. A hub 84 at the upper end of sleeve 80 has threaded bores receiving capscrews 81 for holding a support block 86 on stand offs shown that mounts the support plate 72, using suitable fasteners.

The control handle support plate 72 is securely fixed relative to the sleeve 80, so it will rotate about the axis 82 with the sleeve. The control handle support plate 72 extends rearwardly from axis 82 and has a pair of rearwardly extending spaced side arms 73 that are bent down from the center plate and that pivotally mount a pivoting or tilting control handle mounting section 88 forming part of a drive control assembly between the arms 73 and at the rear portions of the arms 73 on pivots 120. The control handle mounting section 88 has a top plate 89, and channel-shaped side members, each formed with an inner downwardly depending wall 91, a horizontal bottom wall 93 and an upright spaced apart side arm 90 fixed to the horizontal bottom wall 93. The side arms 90 extend above the top plate 89 and a fixed four-sided reference bar or hand rest 92 is mounted on the upper ends of the side arms 90. The hand rest 92 defines a center space and surrounds a movable control handle 94 located in the center space. The control handle 94 is pivotally mounted on pivots 96 to the depending walls 91 of tilting handle mounting section 88, which is pivotally mounted on side arms 73 of the control handle support plate 72. The pivots 96 are at the rear of the pivots for pivoting handle mounting section 88 of the control handle support plate 72 and behind or to the rear of axis 80. The handle 94 will pivot relative to the handle mounting section 88 about a generally horizontal axis of pivots 96, which is transverse to and preferably perpendicular to axis 82. Handle 94, the handle mounting section 88 and control handle support plate 72 also can be moved as a unit about the axis 82 of upright shaft 78 from side to side, to cause the sleeve 80 to rotate as well.

The sleeve 80 has a pair of ears 100 that extend laterally from the sleeve 80 near the lower end. A pivoting channel shaped bracket 102 is mounted on the ears 100 with suitable pivot pins 104 so that channel bracket 102 will pivot about a generally horizontal axis of the pivot pins 104, that is parallel to the pivotal axis of the control handle at pivot shaft 96. The channel shaped bracket 102 extends downwardly from the pivot pins 104 and is coupled to the drive system 32. When the handle 94 is pivoted about the axis 82 of sleeve 80, the corresponding movement of the bracket 102 provides steering control inputs to the drive system 32 as explained in U.S. Pat. No. 7,059,434.

Movement of the bracket 102 about the pivot pins 104 is controlled by the control handle 94 pivoting about the pivot shaft 96. The control handle 94 has a forwardly extending arm or lever 110 that is moved by the handle 94 as the handle pivots as well. A first end of a link 112 is coupled to the control handle 94 by the forwardly extending arm and has a second end coupled to the bracket 102. Thus, when the handle 94 is pivoted about the pivots 96, the arm or lever 110 and the link 112 will move up and down, causing the bracket 102 to pivot about the pivot pins 104. The up and down movement provides direction (forward/reverse) and speed control inputs to the drive system 32, as explained in U.S. Pat. No. 7,059,434.

A drive control assembly 118, including the handle mounting section 88, control handle 94 and the hand rest 92, are pivotally coupled to the side arms 73 of control handle support plate 72 at pivots 120. In some embodiments, the drive control assembly 118 includes additional features, such as speed limiters. The drive control assembly 118 is movable relative to the control support plate 72 about pivots 120 from a first or lowered position to a second or raised position. FIG. 4 shows the drive control assembly 118 in the lowered position and FIG. 5 shows the drive control assembly 118 in the raised position.

A fastener such as a bolt 124 can be provided for adjustably positioning and retaining the drive control assembly 118 about the pivot 120. In other embodiments, the fastener can be hand knob or other suitable fasteners such that tools such as screwdrivers are not needed to loosen the fastener and reposition the pivoting drive control assembly 118. A slot in the side arms 90 of the control handle mounting section 88 is provided for guiding the drive control assembly 118 between the raised and lowered positions. The drive control assembly 118 can be secured relative to the control handle support plate 72 anywhere along the provided slot so that the drive control assembly 118 can be positioned at any selected pivotal location between the raised and lowered positions.

In the illustrated embodiment, the pivot 120 is co-axial with the connection between the arm 110 on control handle 94 and the link 112. Re-positioning the drive control assembly 118 to the raised or lowered position about pivot 120 does not alter the configuration of the control handle 94 relative to the link 112. Therefore, it is not necessary to adjust the link 112 after repositioning the drive control assembly to maintain an equivalent control over the direction and speed control inputs of the drive system 32 of the loader 10. Thus, the loader 10 will have equivalent speed corresponding to pivoting of the control handle 94 regardless of the pivoted position (up or down) of the drive control assembly 118.

The loader 10 can be controlled by the operator with the drive control assembly 118 and control handle 94 in either the raised or lowered position. If the loader 10 is being operated in a walk-behind mode, in which the ride-on platform 40 is detached or moved out of the way so that the operator walks behind the loader 10 to operate the loader 10, as shown in FIG. 1, the drive control assembly and control handle 94 can be in the lowered position. Conversely, if the loader 10 is being operated in a ride-on mode so that the operator is supported on the ride-on platform 40 behind the loader 10, as shown in FIG. 2, the drive control assembly 118 and the control handle 94 can be moved upwards into the raised position. In addition, the drive control assembly 118 and the control handle 94 can be moved into the lowered or raised position to allow differently sized operators to move the control handle to their preference. For example, a taller operator may prefer the control handle 94 in the raised position while a shorter operator may prefer the control handle 94 in the lowered position.

The drive control assembly 118 can be moved to a raised or lowered position to provide a more comfortable grasping and resting configuration for the operator. This can reduce operator fatigue and increase productivity by increasing the operator's length of operation.

Thus, the invention provides, among other things, an adjustable hand control for controlling operation of a small loader.

Although the present invention has been described with reference to preferred embodiments, workers skilled in the art will recognize that changes may be made in form and detail without departing from the spirit and scope of the invention.

What is claimed is:

1. A control system for a vehicle having a frame, comprising:

a power traction ground drive coupled to the frame for propelling the frame in forward and reverse directions;

a control support plate mounted at a forward end thereof relative to the vehicle to a pivotable member for rotation about an upright axis for providing steering inputs for steering the vehicle;

a drive control assembly pivotally mounted about a generally lateral first axis to a rear portion of the control support plate and extending rearwardly from the control support plate;

a control handle coupled to the power traction ground drive and pivotally mounted on the drive control assembly about a second lateral axis independent of and rearwardly from the first axis, the control handle pivotally actuable about the second lateral axis in a forward direction and a rearward direction with respect to the drive control assembly to provide one of a directional speed control input; and wherein pivoting of the drive control assembly about the first axis moves the control handle and the drive control assembly between a first height and a second height, and the control handle maintains its pivotal position about the second axis as the drive control assembly pivots about the first axis.

2. The control system of claim 1, the control support plate comprising part of an operator's control, the vehicle moving on a supporting surface and having a selectively usable operator support elevated from the support surface, the control handle first and second heights being usable by an operator selectively standing on the supporting surface or on the operator support.

3. The control system of claim 1, wherein the drive control assembly includes a handle mounting section, the handle mounting section being pivoted about the first axis, the handle mounting section including portions that extend out from the first axis in direction away from the control support plate, the control handle being pivoted at a location spaced from the first axis and on the portions of the handle mounting section that extend out from the first axis.

4. The control system of claim 1 further comprising a control link movable substantially parallel to the upright axis, the control link being coupled to the control handle through a pivot connection having a connection axis substantially coincident with the lateral first axis, pivoting of the control handle causing movement of the control link.

5. The control system of claim 1 wherein the control support plate has a pair of laterally spaced arms, the drive control assembly being positioned between the pair of laterally spaced arms.

6. The control system of claim 1 wherein said control support plate is supported on the frame of the vehicle, the control support plate being at a rear portion of the vehicle, the control handle being pivoted to the drive control assembly rearwardly of the first axis.

7. The control system of claim 6 wherein said vehicle is operable by an operator walking behind the vehicle when the vehicle is moving on a support surface, and a control platform couplable to the vehicle for supporting an operator above the support surface.

8. A self-propelled walk behind vehicle having a control support plate at a rear portion of the vehicle accessible to an operator behind the vehicle, the control support plate having a first section mounted on a support pivotable about an upright axis, a control handle mounting section pivotally mounted to the first section of the control support plate about a first axis extending laterally of a fore and aft direction of the vehicle, the control handle mounting section extending rearwardly of the first section of the control support plate and rearwardly of the first axis, a control handle pivoted to the control handle mounting section about a second axis spaced rearwardly from the first axis and actuable about the second lateral axis from an unactuated position, the control support plate and control handle being operably coupled to control forward and rearward movement and direction of the vehicle, the control handle mounting section being movable about the first axis relative to the first section of the control support plate about the first axis to thereby move the control handle in its unactuated position to different elevations relative to a supporting surface for the vehicle without changing the unactuated position of the control handle about the second axis.

9. The vehicle of claim 8 wherein the vehicle has a removable support platform that is raised above the supporting surface.

10. The vehicle of claim 8 wherein the control handle is operable to operate controls for the vehicle through a linkage including a pivot connection, the pivot connection having an axis aligned with the first axis so the linkage operated by the control handle continue to be operable by the control handle when the control handle mounting section is pivoted about the first axis.

11. The vehicle of claim 8 and a stop retaining the handle mounting section in a desired position about the first axis.

12. An adjustable height control for a mobile vehicle having a drive controllable by a standing operator from a rear of the vehicle, a control support plate on the vehicle at the rear of the vehicle, a control handle mounting section pivotally mounted about a first generally lateral axis to the control support plate and extending rearwardly from the control support plate, a control handle for controlling drive functions of the vehicle pivotally mounted on the control handle mounting section about a second lateral axis independent of the first axis and actuable to pivotable positions about the second lateral axis from an unactuated position, pivoting of the control handle mounting section about the first axis moving the control handle between a first height and a second height without changing the unactuated position of the control handle about the second axis.

13. The adjustable height control of claim 12, wherein the vehicle is steerable and the drive includes forward and reverse drives, the control support plate being pivotally mounted about an upright axis and pivoting of the control support plate about the upright axis providing steering inputs to the drive.

14. The adjustable height control of claim 13, wherein the pivoting of the control handle about the second axis provides forward and reverse drive inputs to the drive for the vehicle.

* * * * *